United States Patent [19]

Ganatsiou

[11] 3,994,427

[45] Nov. 30, 1976

[54] AUTOMATIC SHEET JOGGING AND STAPLING MACHINE

[75] Inventor: Thomas J. Ganatsiou, Trumbull, Conn.

[73] Assignee: Pitney-Bowes, Inc., Stamford, Conn.

[22] Filed: Apr. 29, 1975

[21] Appl. No.: 572,749

[52] U.S. Cl. ..... 227/100; 227/3; 227/7

[51] Int. Cl.[2] ..... B27F 7/06

[58] Field of Search ..... 227/2, 3, 4, 5, 6, 7, 227/100; 270/53; 271/224, 236, 245, 248, 253, 207

[56] References Cited

UNITED STATES PATENTS

| | | | |
|---|---|---|---|
| 1,276,528 | 8/1918 | Hopping | 227/3 |
| 2,747,189 | 5/1956 | Fenimore | 270/53 |
| 2,770,192 | 11/1956 | Mitchell et al. | 271/207 X |
| 2,994,881 | 8/1961 | Kaufman | 227/7 |
| 3,053,531 | 9/1962 | Green et al. | 271/245 X |
| 3,055,009 | 9/1962 | March | 227/3 |
| 3,416,715 | 12/1968 | Fenimore | 227/3 |

*Primary Examiner*—Granville Y. Custer, Jr.
*Attorney, Agent, or Firm*—William D. Soltow, Jr.; Albert W. Scribner; Hugh D. Jaeger

[57] ABSTRACT

An automatic sheet jogging and stapling machine is disclosed and includes a downwardly, sidewardly inclined platform for receiving sheets of paper, and a side wall and bottom release gate that extend upwardly from the platform to define a sheet receiving corner. Longitudinally and laterally movable jogging fingers are provided to align the sheet edges against the release gate and side wall and a stapling head is mounted spaced above the sheet receiving platform to staple the sheets together. The release gate is opened to gravitationally eject the stapled paper. A cam operated control sequentially actuates the longitudinally and laterally movable jogging fingers, the stapling head, and the release gate.

5 Claims, 11 Drawing Figures

AUTOMATIC SHEET JOGGING AND STAPLING MACHINE

BACKGROUND OF THE INVENTION

1. Field of the Invention

The present invention relates to an automatic sheet jogging and stapling machine which assembles sheets of paper into a bundle having aligned edges, staples the bundle together, and gravitationally releases it for subsequent stacking. Such machines may advantageously be utilized in printing and photocopying businesses where documents, having many pages of identical size, are produced or reproduced, assembled, and bound to form pamphlets or booklets. Similarly, such machines may be used in offices or other businesses to assemble and bind multipage documents in a quick, efficient, and reliable manner.

Because present printing and photocopying apparatus operate at high speed, it is important that paper assembling and binding machines used with them also be capable of similar high speed operation. Moreover, such machines should be compact and easily integrated with existing equipment. It is also desirable to automate a document assembling and stapling operation when the documents have large numbers of pages that would ordinarily be difficult to staple by hand.

2. Description of the Prior Art

Paper jogging and stapling machines are presently known. For example, U.S. Pat. No. 2,994,881 (Kaufman) discloses a machine having a downwardly inclined tray provided with two side walls to form a U-shaped paper guide. A previously assembled bundle of paper is deposited on the tray and slides down its face until stopped by two pins that project upwardly from beneath the tray's surface. A microswitch is mounted to be tripped by the paper bundle as it slides through the channel and operates a delayed action relay which in turn operates a stapling head. After the stapling operation is complete, the stop pins are withdrawn beneath the tray surface to permit the paper bundle to fall into a bin.

Though uncomplicated, such prior art machines have several drawbacks. For example, the machine disclosed in the Kaufman patent relies on the impact of the paper bundle against the stop pins to longitudinally bounce and jog the individual paper sheets to thereby longitudinally align the sheet edges. Further, it doesn't jog the paper sheets in a lateral direction at all. The paper bundle is assembled before it is introduced into this machine and if not properly laterally aligned, the bundle may bind between the side walls of the paper tray and interrupt operation. Accordingly, such machines may not be well suited for use with the high speed printing and office equipment.

SUMMARY OF THE INVENTION

In a preferred embodiment to be described below in detail, the automatic paper jogging and stapling machine of the present invention includes a downwardly, sidewardly inclined platform for receiving sheets of paper. A side wall and a bottom release gate extend upwardly from the platform to define a corner to which a corner of each sheet of paper received on the platform is gravitationally fed. The platform is provided with a first series of longitudinal slots and a second series of lateral slots. Two banks, each comprising two longitudinally movable jogging fingers are carried beneath the platform surface to be transported through longitudinal slots and jog paper received on the platform against the release gate. Similarly, two laterally movable jogging fingers are carried beneath the platform and oscillate in the lateral slots to jog the paper received on the platform against the side wall.

The longitudinally movable jogging fingers are mounted on a transverse rod which is in turn carried on an endless drive chain loop mounted beneath the paper receiving platform. The two banks of jogging fingers are provided to twice jostle the paper sheet bundle in a longitudinal direction. Further, each bank of longitudinal jogging fingers is spring loaded to be retracted under the paper receiving platform. An adjustable stop is carried in one of the longitudinal slots to selectively determine the position at which this retraction occurs to accommodate paper of various lengths.

The lateral jogging fingers are also carried on a transverse rod which is mounted on a lever pivoted beneath the paper receiving platform. An actuator solenoid is coupled to the pivoted lever to move these jogging fingers through the laterally disposed slots. This solenoid may be operated in a controlled sequence to repeatedly jog the paper bundle against the side wall. The lateral jogging fingers are also adjustable to accommodate paper of various widths.

A stapling head is mounted spaced above the paper receiving platform to staple the paper bundle together. In the preferred embodiment, the stapling head functions to drive a staple through the upper left hand corner of the paper bundle when the paper is received face up, top edge down. However, the stapling head may be otherwise positioned as desired or the automatic machine of the present invention may be provided with more than one stapling head, for example, two heads mounted to staple the paper bundle along one edge.

The release gate is operable to be moved away from abutting contact with the paper receiving platform, that is, to be moved away from a closed position so that the stapled paper bundle may be gravitationally ejected from the platform. A bin may be provided to receive the stapled paper bundles and thus automatically stack them.

A master cam control sequentially actuates the longitudinally and laterally movable jogging fingers, the stapling head, and the release gate. This control may be manually operated by a person who monitors the collating and assembly of the paper bundles in the machine. Alternatively, however, the machine of the present invention may be provided with an automatic control which is activated when the paper bundle is completely assembled on the paper receiving platform.

This automatic paper jogging and stapling machine functions in four modes to align the edges of a paper bundle on which it operates. In particular, the sidewardly, downwardly inclinded paper receiving platform gravitationally guides each sheet of paper to the corner defined by the side wall and bottom release gate. Accordingly, each sheet of paper has one side, in one mode, and one bottom edge, in a second mode, aligned by gravitationally induced impact with the respective side and bottom barriers. The longitudinally movable jogging fingers function to mechanically jog the completed bundle of paper sheets against the bottom release gate in a third mode. And the laterally movable jogging fingers function to mechanically jog the completed paper bundle against the side wall in a fourth mode.

The machine may be operated in conjunction with presently existing printing and photocopying apparatus to complete a document producing, assembling, and binding machine or system. Further, this machine is adapted to operate at high speed to fasten documents containing many pages together in a well aligned booklet or pamphlet.

Therefore, it is an object of the present invention to provide a novel automatic paper jogging and stapling machine which is capable of high speed operation and which may be integrated into a line or machine with presently existing photocopying or printing equipment or which may be operated independently.

Other objects, aspects, or advantages of the present invention will be pointed out in, or will be more fully understood from, the following detailed description when considered in conjunction with the accompanying drawings.

DETAILED DESCRIPTION OF THE PREFERRED EMBODIMENT

Figure 1:
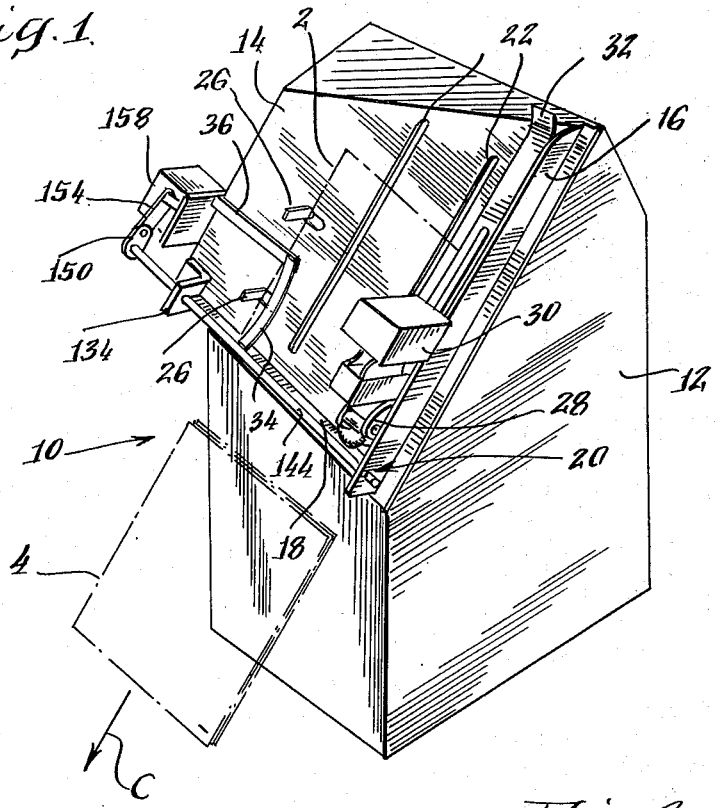
FIG. 1 is a perspective view of the automatic paper jogging and stapling machine of the present invention. A bundle of papers is shown in phantom lines both positioned on the paper receiving platform and being released from that platform.
Figure 2:
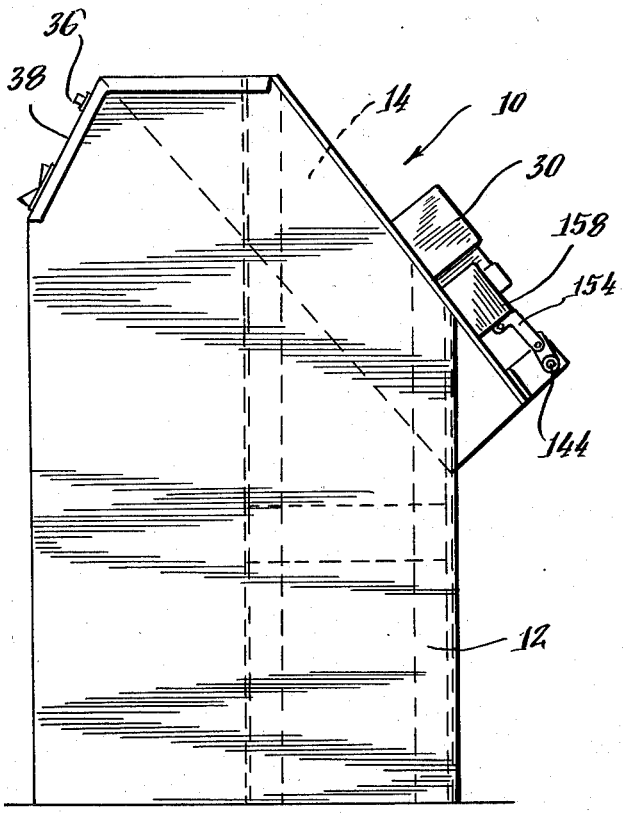
FIG. 2 is a side elevational view of the automatic paper handling machine looking from the left in FIG. 1.
Figure 3:
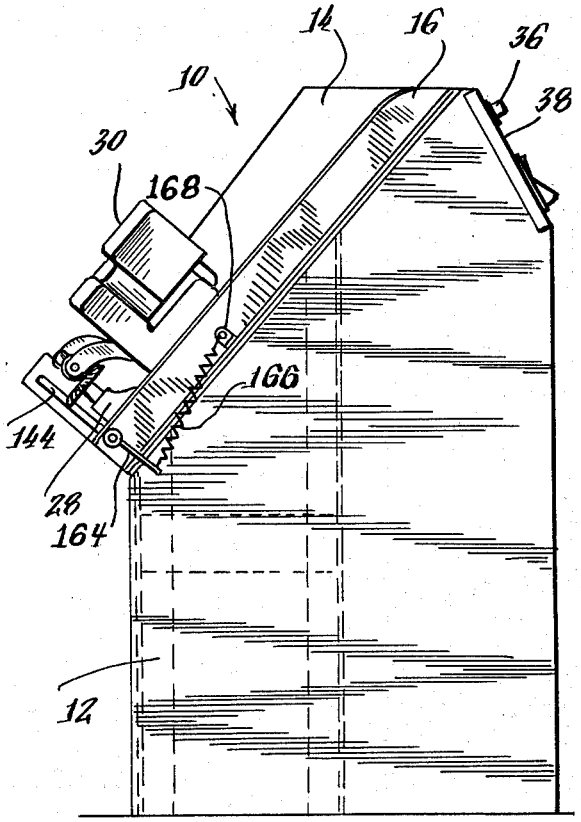
FIG. 3 is a second side elevational view of this paper handling machine looking from the right in FIG. 1.

FIGS. 1, 2, and 3 illustrate the preferred embodiment of the automatic paper jogging and stapling machine, generally indicated at 10, of the present invention. This machine is housed in a compact cabinet 12 which is approximately 30 inches (76.2 cm) high, 14 inches (35.6 cm) wide and 20 inches (50.8 cm) deep. Accordingly, it may be installed on the floor in a small office or factory or integrated into larger printing or photocopying machinery.

This paper handling machine 10 includes a paper receiving platform 14, inclined downwardly at an angle of approximately 45° and sidewardly at an angle of approximately 30°, which transports and holds sheets of paper such as that shown at 2 by phantom lines in FIG. 1. A side wall 16 is permanently mounted on the lower sidewardly inclined edge of and extends upwardly from the paper receiving platform 14 to form a side barrier. A release gate 18 is reciprocally mounted on the bottom edge of the paper receiving platform to form a bottom barrier. As shown in FIG. 1, the side wall 16 and release gate 18 intersect at a 90° angle to define a corner, generally indicated at 20, where a corner of each sheet received on the platform 14 is aligned by the force of gravity acting through the platform's double inclination. That is, the longitudinal edges of individual sheets or of a bundle of sheets of paper are caused to abut the side barrier wall 16 by the force of gravity acting through the sideward inclination of the paper receiving platform 14. Similarly, the bottom edges of individual sheets or a bundle of paper are caused to abut the release gate by the force of gravity acting through the downward inclination of the paper receiving platform 14. In this manner, the paper 2 is first gravitationally aligned in two modes, longitudinally and laterally, by its impact with the side wall and release gate.

Two longitudinal slots 22 and two lateral slots 24 are disposed in the paper receiving platform. A pair of longitudinally movable jogging fingers, to be described in greater detail below, are adapted to move downward through the longitudinal slots to jog the paper 2 against the release gate 18. Similarly, a pair of laterally movable jogging fingers are positioned to laterally move in slots 24 to jog the paper 2 against the side barrier wall 16. Accordingly, the paper 2 is also mechanically aligned in two modes, longitudinally and laterally, by the respective jogging fingers. Thus, the machine of the present invention operates in four modes, two gravitational and two mechanical, to insure that all paper is neatly formed into a bundle having aligned edges.

A stapling head 28 is mounted at the corner 20, spaced above the paper receiving platform 14, and a staple clinching anvil, which functions to bend the legs of a staple driven from the head, is formed in the paper receiving platform. An actuator 30 is positioned to operate the head 28 and will be described in greater detail below.

Paper is guided under the stapling head by a generally horizontal paper guide 32 mounted on the side barrier wall 16. A retaining spring 34, mounted on an arm 36, presses paper against the receiving platform 14 and prevents the paper from over-shooting the release gate 18.

The release gate 18 is mounted to reciprocally move away from the paper receiving platform 14 to release the paper bundle, permitting it to be gravitationally ejected as shown at 4 by phantom lines in FIG. 1. A bin or other stacking device (not shown) may be provided to receive the stapled bundles of paper.

A control is provided to sequentially actuate the longitudinal and laterally movable jogging fingers, the stapling head, and the release gate so that the paper is first laterally and longitudinally justified, second fastened together into a booklet, and third ejected from the machine. This control may be actuated by a button 36 mounted on a control panel 38 or by a foot pedal (not shown). Alternatively, this control may be actuated by an automatic sensor such as a photo cell and light source which determines when an assembled paper bundle has been received on the platform 14 or which determines when an assembly of the paper bundle has been completed on the paper receiving platform.

Figure 4:
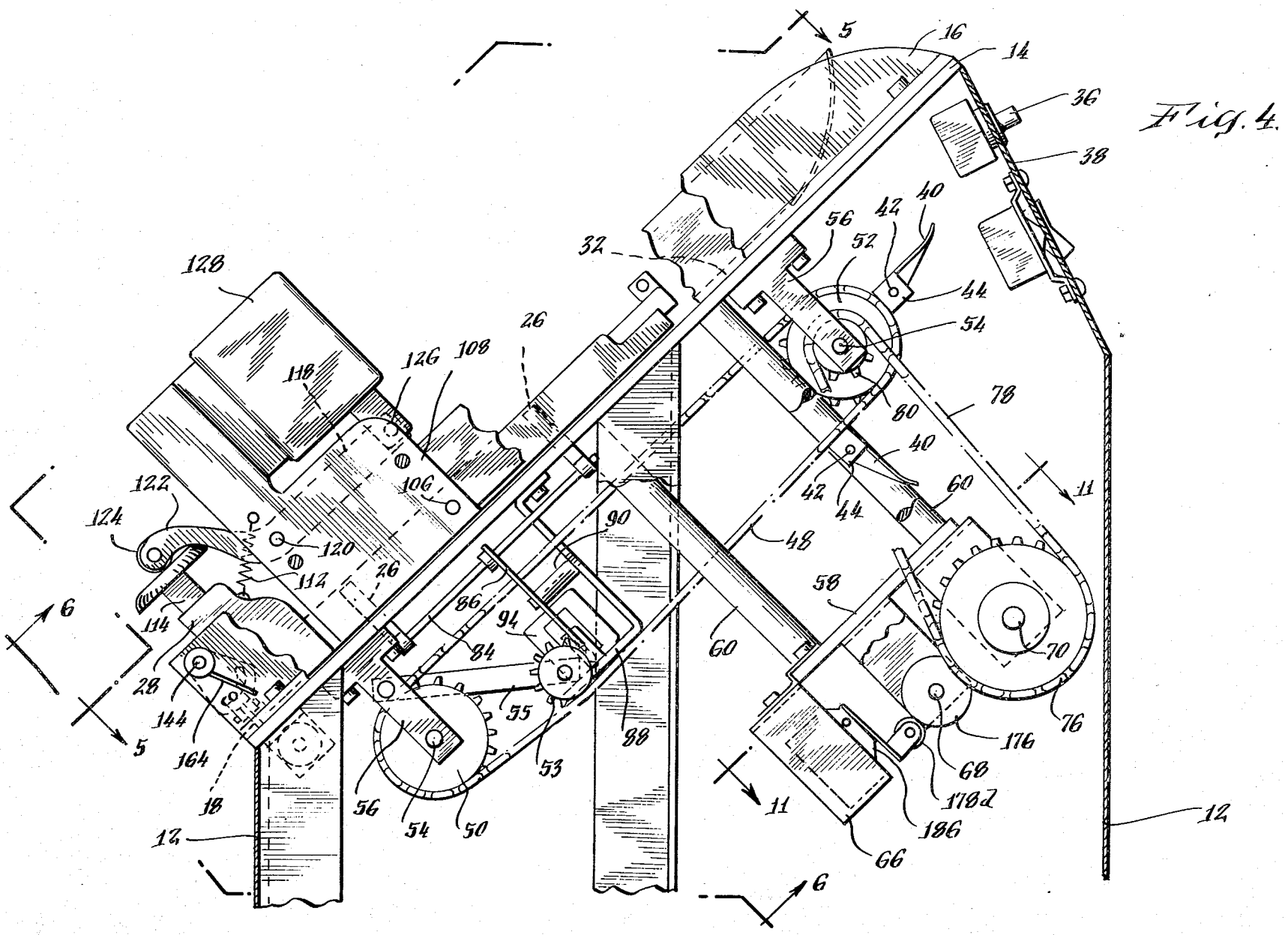
FIG. 4 is an enlarged view similar to that illustrated in FIG. 3, partly in cross section, showing the mechanism for transporting the longitudinally movable jogging fingers mounted beneath the paper receiving platform.

The longitudinally movable jogging fingers are best described with reference to FIGS. 4 through 8. There are two banks of such fingers, each having two longitudinally movable jogging fingers 40 carried on a rod 42 which is pivoted in an elongate bracket 44. A coil spring 46 urges the jogging fingers 40 to rotate in a counter clockwise direction as seen in FIG. 4. However, when the jogging fingers abut an obstruction on the platform, they retract by pivoting in a clockwise direction on the rod 42 against the force of the spring 46.

Each bracket is fixed to a drive member which may be an endless chain 48 that is reeved about two wheels which may be sprockets 50 and 52 and is tightened by a tensioning sprocket 53 mounted on a spring loaded arm 55. Each sprocket 50 and 52 is mounted for rotation on a shaft 54 which is supported between two depending standards 56 mounted on the underside of the paper receiving platform 14. The endless chain 48 defines a common tangent between the respective sprockets 50 and 52 which is substantially parallel to the paper receiving platform 14.

Figure 5:
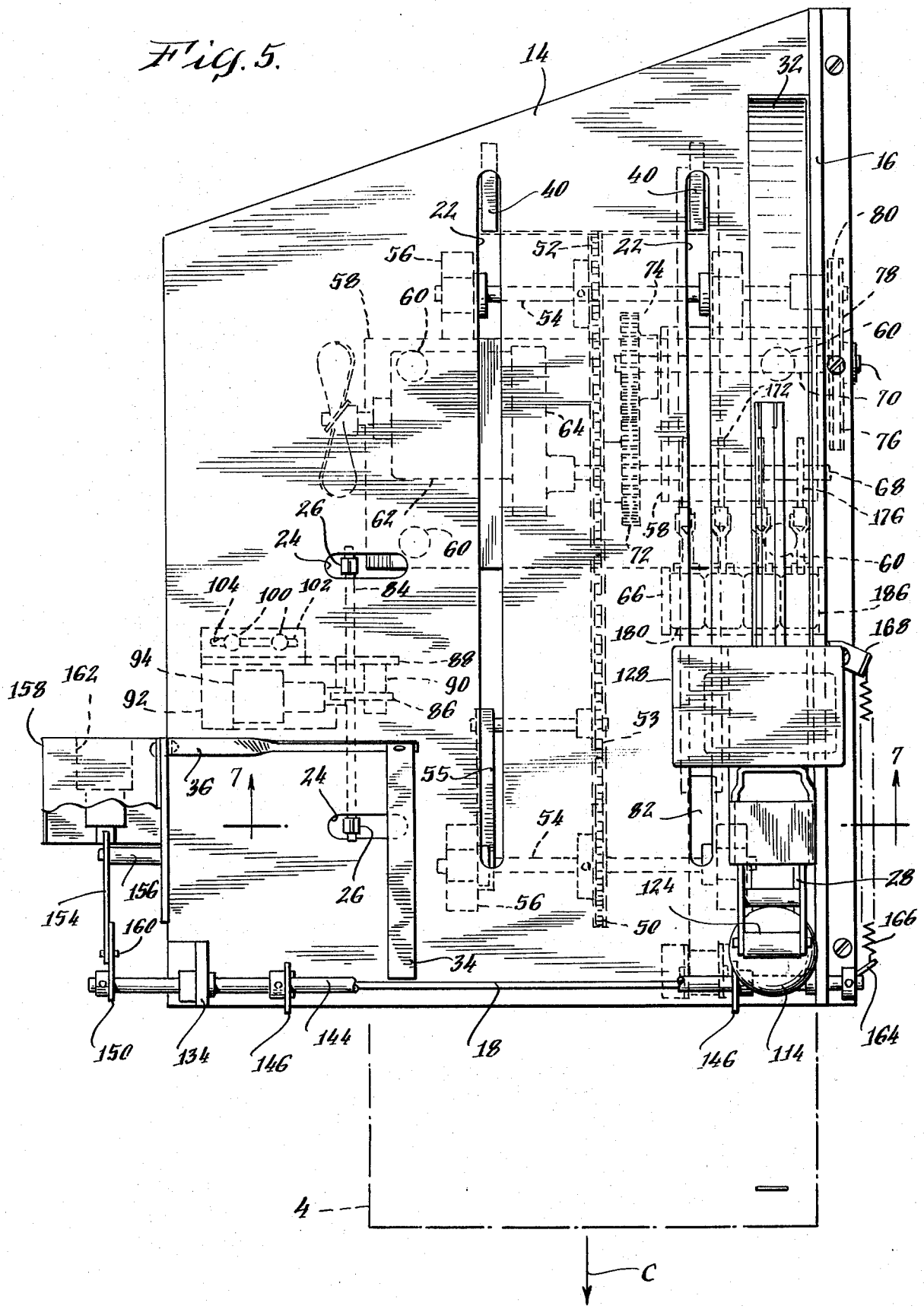
FIG. 5 is a top view of the paper receiving platform taken from plane 5—5 of FIG. 4. The various mechanisms for transporting the longitudinally and laterally moving jogging fingers are illustrated in phantom lines.
Figure 6:
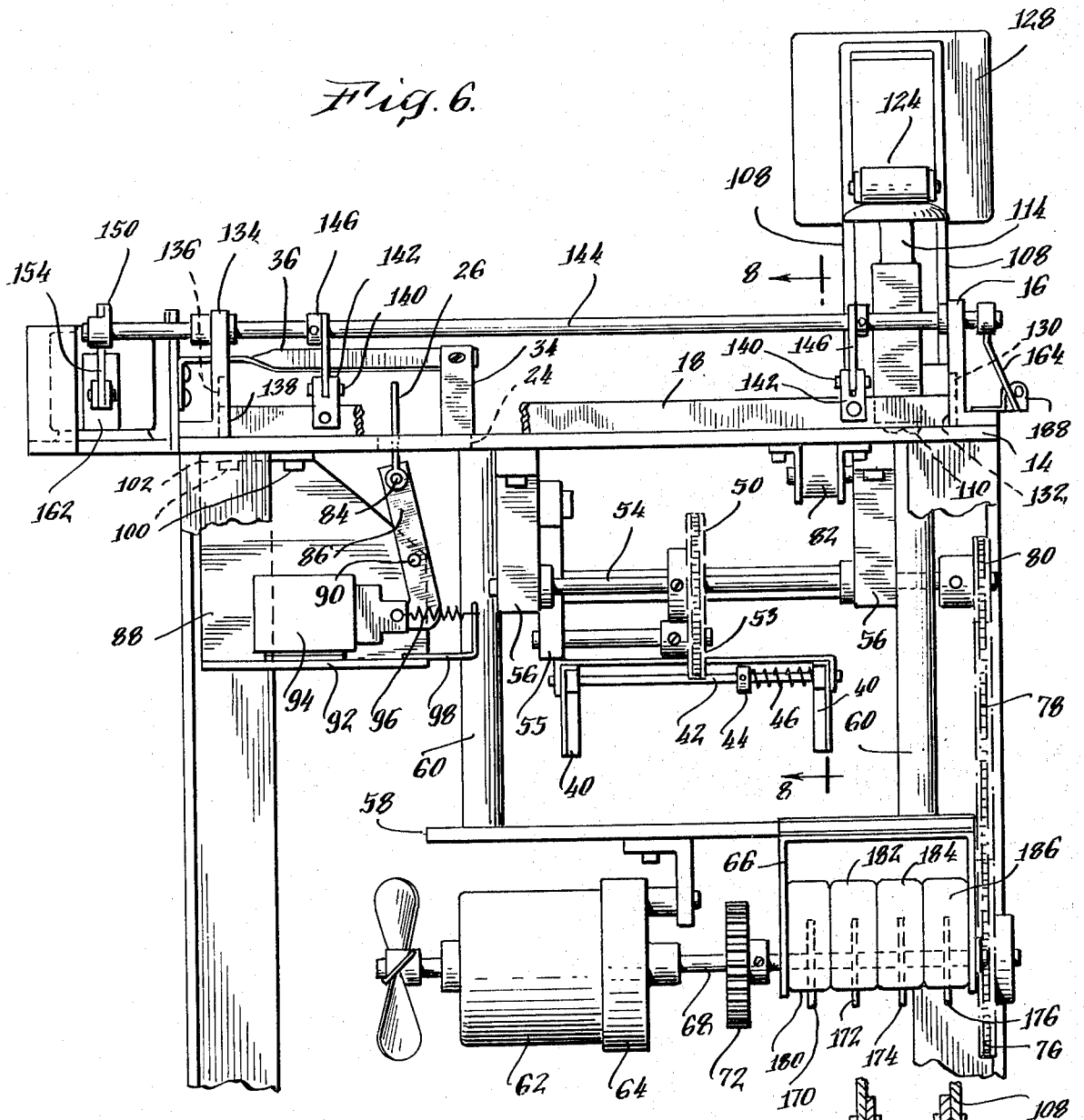
FIG. 6 is a front view of this paper handling machine, shown partly in cross section, taken from discontinuous plane 6—6 in FIG. 4. The apparatus for moving the laterally movable jogging fingers is shown in detail.

The endless chain 48 and hence the jogging fingers 40 is driven by a power train which can be seen in FIGS. 4, 5, and 6. A mounting platform 58 is suspended below the paper receiving platform 14 on four depending pillars 60 and supports an electric motor 62 and a speed reducing gear box 64. A U-shaped bracket 66 is also fixed to the under side of the mounting platform 58 and houses two shafts 68 and 70. The first shaft 68 projects from the speed reducing gear box 54 and carries a drive gear 72 that meshes with a driven gear 74 mounted for rotation with the second shaft 70. A drive sprocket 76, mounted at the opposite end of the shaft 70 for rotation with it powers endless chain 78 which, in turn, powers a driven sprocket 80 coupled to one of the shafts 54. In this manner, one sprocket 52 is driven to power the jogging fingers 40.

Figures 8, 9, 10:
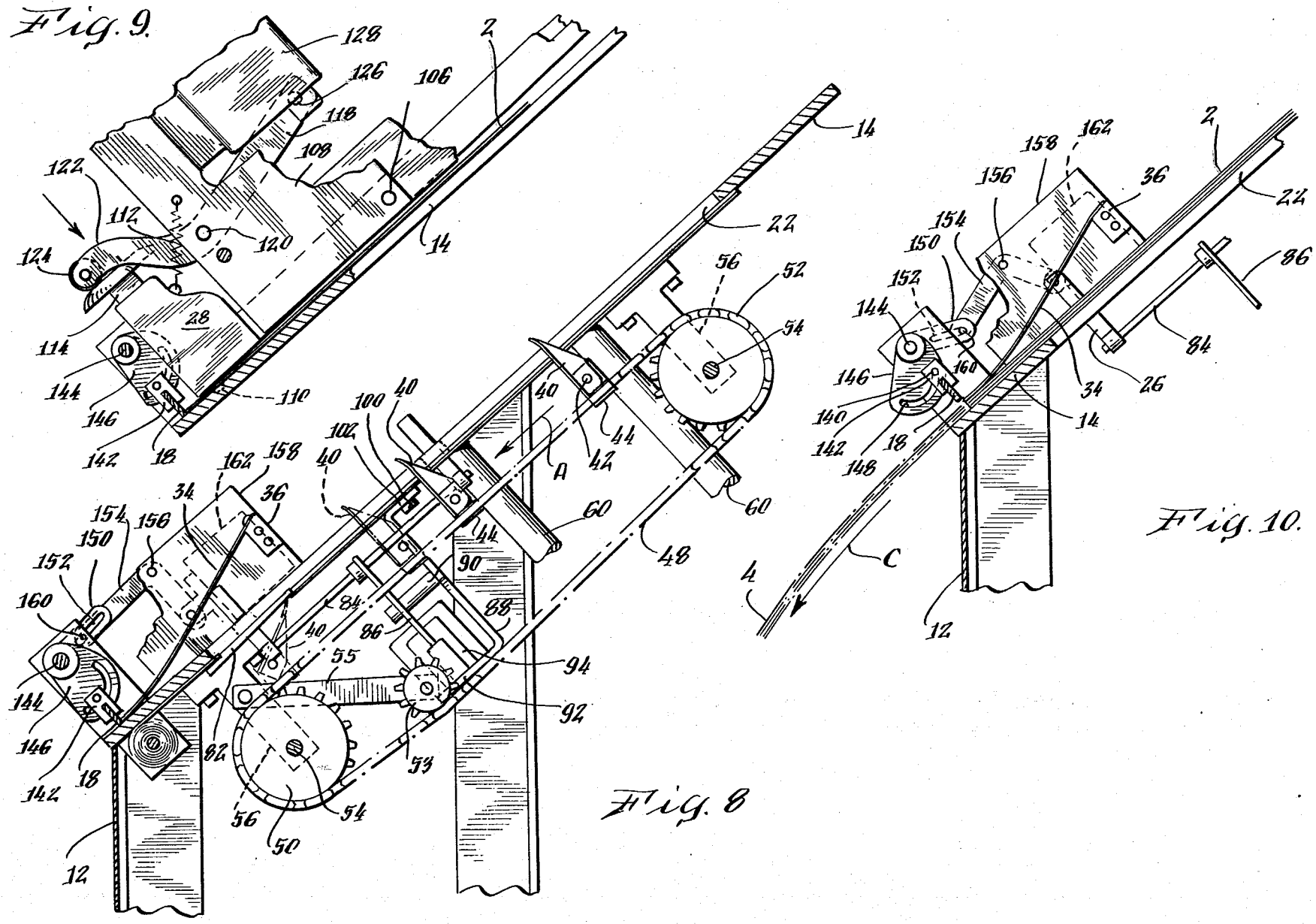
FIG. 8 is a view partly in cross-section taken through plane 8—8 in FIG. 6 illustrating the longitudinal movable jogging fingers being transported through the longitudinal paper receiving platform slots.
FIG. 9 is an enlarged side elevational view of the stapling head and the mechanism for operating it.
FIG. 10 is an enlarged side elevational view of the release gate and its actuator mechanism.

An adustable stop block 82, shown in detail in FIG. 8, is positioned in one of the longitudinal slots 22 to form an obstruction and set the position at which the longitudinally movable jogging fingers are retracted beneath the paper receiving platform. The longitudinal position at which this stop block is set is determined by the length of paper being bundled by the machine.

FIG. 4 illustrates both banks of longitudinally movable jogging fingers 40 in their rest position, that is, both banks of jogging fingers are positioned beneath the paper receiving platform. FIG. 8 illustrates the cycle through which these jogging fingers are moved. In particular, when the endless chain is driven by the electric motor, as indicated by the arrow A, the jogging fingers rotate to project through the longitudinal slots 22. Here they abut the top edge of any paper received on the paper receiving platform 14 to jog the paper against the release gate 18. In this manner, the paper is longitudinally justified or aligned into a neat bundle. As the jogging fingers 40 abut and align the paper against release gate 18 into an aligned longitudinally neat justified bundle, the force of jogging fingers 40 against the aligned paper bundle reaches a point greater than the spring constant of coil spring 46, which biases jogging fingers 40 in an upward position, thereby causing jogging fingers 40 to deflect downwardly below the leading edge of the aligned paper to a depressed position below the lowermost sheet in the stack. The force exerted by coil spring 46 has a spring constant such that it allows jogging fingers 40 to align the paper into engagement with gate 18, but yet results in jogging fingers 40 deflecting below the leading edge of the aligned paper to a depressed position when the predetermined spring constant is overcome by the force of jogging fingers 40 acting against the leading edge of the aligned paper at release gate 18 so as not to crumple or mutilate the paper. The force exerted by spring 46 continues to deflect jogging fingers 40 in a downwardly direction depressed below the lowermost sheet of aligned paper in the stack until jogging fingers 40 are retracted beneath the paper receiving platform 14 at adjustable stop block 82. When the jogging fingers have moved further down the longitudinal slots 22 as shown in phantom line, each bank successively abuts stop block 82 to be retracted beneath the paper receiving platform 15. The jogging fingers are then returned along the lower leg of the endless chain 48 to their rest position as shown in FIG. 4.

Figure 7:
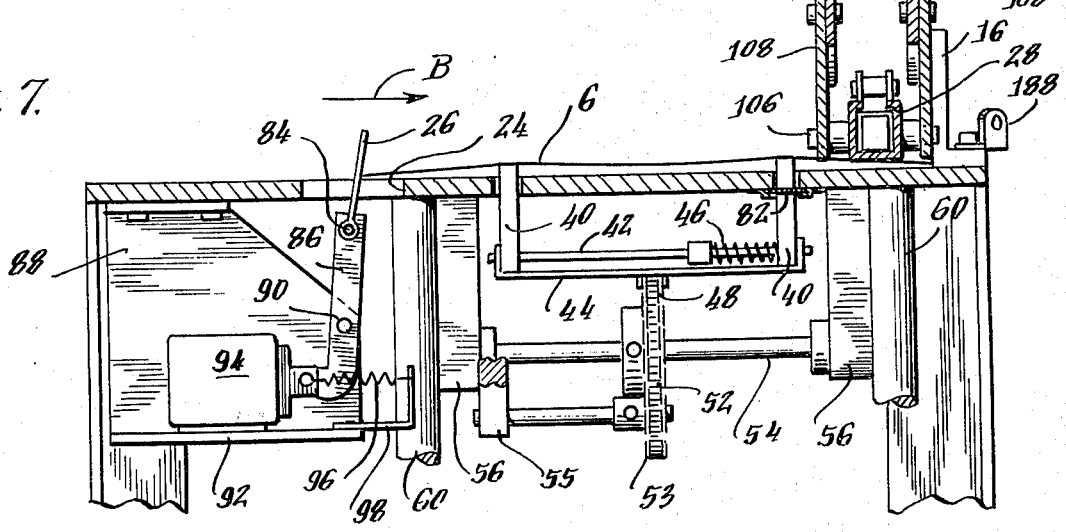
FIG. 7 is a partial cross-sectional view taken through plane 7—7 in FIG. 5.

The laterally moving jogging fingers 26 and the mechanism for actuating them are best illustrated in FIGS. 4 through 7. Both jogging fingers 26 are connected to a longitudinally positioned rod 84 for simultaneous movement in the lateral slots 24. Rod 84 is mounted on a pivot lever 86 which is pivoted in a support frame 88 about a pivot shaft 90. The support frame 88 is suspended from the underside of the paper receiving platform and includes a portion 92 which is generally parallel to that platform. A solenoid 94, mounted on the parallel frame portion 92, is linked to the opposite end of the pivot lever 86 and when energized, pulls the bottom portion of the lever 86 leftward to move the laterally movable jogging fingers 26 rightward as indicated by arrow B in FIG. 7. FIG. 6 illustrates the jogging fingers 26 in their rest position and FIG. 7 illustrates the jogging fingers laterally moved toward the side wall 16. A return spring 96 is stretched between a bracket 98 mounted on the support frame 88 to return the solenoid and the laterally moving jogging fingers to their rest position.

The support frame 88 is coupled to the paper receiving platform 14 by two machine screws 100 which pass through a flange 102 and permits the support frame 88 to be adjusted laterally so that jogging fingers 26 may accommodate various widths of paper.

As shown in FIG. 7, when the laterally moving jogging fingers 26 are shifted rightward, they jog paper sheets indicated at 6, against the side wall 16 to laterally justifying or laterally align the side edges of the paper bundle.

Accordingly, the longitudinally and laterally moving jogging fingers combine to justify all four edges of the paper bundle to form a neat booklet or pamphlet.

The stapling head 28 is mounted spaced above the paper receiving platform 14 and is provided on a shaft 106 which spans a frame 108. As shown in FIGS. 6 and 9, the stapling head 28 is mounted opposite a staple clinching anvil 110, shaped to bend the legs of a staple to grasp and bind the bundle of paper. The stapling head 28 is urged to a rest position shown in FIG. 4 spaced from the stapling foot 110 by a stretched spring 112 coupled between the head and the frame 108.

The plunger 114 of the stapling head 28 is actuated by a lever 118 pivoted about a pin 120 in frame 108. The first end 122 of the lever 118 is provided with a roller 124 which travels on the head of the plunger 114. The opposite end 126 of the lever 118 is coupled to solenoid 128 of actuator assembly 30. When energized the solenoid 128 pulls end 126 upwardly driving end 122 downwardly, depressing the stapling head plunger 114, and driving a staple as shown in FIG. 9.

The release gate 18 and the mechanism which operates it are illustrated in detail in FIGS. 5, 6, 8, and 10. The side wall barrier 16 has a generally vertical slot 130 which engages one end 132 (FIG. 6) of the release gate 18. A generally vertical plate 134, mounted at the lower edge of the paper receiving platform 14 opposite side wall 16, also has a vertical slot 136 which accepts the second end 138 of the release gate 18. Accordingly, the gate may be moved upward and downward guided in the opposing slots 130 and 136. A pair of link pins 140 are carried in U-shaped mounting brackets 142 which are linked to the gate 18. A rotatable drive rod 144 spans the distance between the side wall 16 and the vertical plate 132, and is mounted above the gate 18. Rod 144 carries two slotted cams 146 each having an arcuate cam slot surface 148 which engages a link pin 140. As shown in FIG. 10, when rod 144 rotates, the cams vertically pull the gate away from the surface of the paper receiving platform permitting the stapled paper bundle to be gravitationally ejected as shown by Arrow C. However, when rod 144 is rotated in a counterclockwise direction as shown in FIGS. 10 and 9, the gate is returned to contact the surface of platform 14.

As shown in FIGS. 6, 8 and 10, one end of the drive rod 144 is provided with a crank 150 having a linear cam slot surface 152. A lever 154, pivoted about pin 156 mounted in a housing 158, has a follower finger 160 which engages the linear cam surface 152. The end of the lever opposite the follower finger 160 is coupled to a solenoid 162 mounted in the housing 158. When energized, the solenoid actuates the lever 154 to depress the crank 150 to pull the release gate away from contact with the paper receiving platform surface as shown in FIG. 10.

As shown in FIGS. 5 and 6, the opposite end of the drive rod 144 is provided with a second crank 164 connected to a coil spring 166 which is secured to a tab 168 mounted on the paper receiving platform 14. This crank-coil spring arrangement urges the release gate to its closed position against the influence of the solenoid. Accordingly, when the solenoid is de-energized, the release gate automatically closes.

Figure 11:
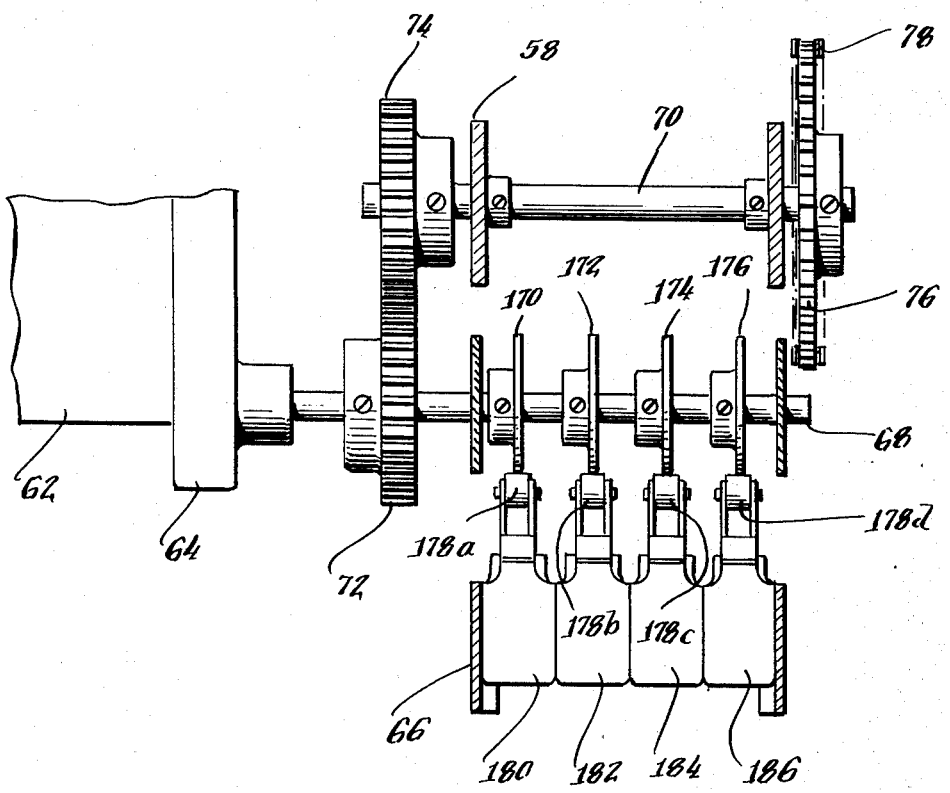
FIG. 11 is an enlarge view taken through plane 11—11 in FIG. 4 showing the cam mechanism for controlling the longitudinally and laterally movable jogging fingers, the stapling head, and the release gate.

The cam mechanism for sequentially operating the longitudinally and laterally movable jogging fingers, the stapling head, and the release gate, is illustrated best in FIGS. 6 and 11. The shaft 68 supported in the U-shaped bracket 66 is provided with a series of four circular cams, 170 through 176. Each cam is positioned to operate the follower 178 *a, b, c, d* of one of four microswitches 180 through 186.

The power train from the electric motor to the endless chain which moves the longitudinally movable jogging fingers is geared so that one revolution of the shaft 68 completes one cycle of movement of those jogging fingers. Accordingly, the cams 170 through 176 are set so that, for each revolution the laterally movable jogging fingers, the stapling head, and the release gate, are each operated one time.

Microswitch 180 completes a circuit to the electric motor 62 and, when open, stops the electric motor. However, the control button 36, a foot pedal, or alternative automatic control, bypasses microswitch 180 to start the motor running.

Microswitch 182 energizes the solenoid which operates the laterally movable jogging fingers. Preferably the cam 172 is provided with two or more dwell portions to operate the laterally moving jogging fingers more than one time for each bundle of paper.

Microswitch 184 is adapted to energize the solenoid 128 which operates the stapling head 28. Its corresponding cam 174 is set to close the microswitch 184 only once during each cam revolution.

Mircoswitch 186 is adapted to energize the solenoid 162 which actuates the release gate. The cam 176 which operates this microswitch 186 is preferably provided with an extended dwell period during which the microswitch is closed to insure that the paper is properly, gravitationally ejected from the paper receiving platform 14.

Microswitch 180 and its corresponding cam 170 are arranged to open at the conclusion of a jogging, stapling, and ejecting cycle. A second cycle is initiated by bypassing microswitch 180 with the control button 36 or other alternative bypass switching means. The four cams 170 through 176 are arranged, to sequentially operate the laterally movable jogging fingers, the stapling head, and the release gate. Accordingly, the paper is first jogged longitudinally and laterally, then stapled, and finally ejected from the paper receiving platform into a bin (not shown) or to other means for subsequent stacking.

Actuators other than solenoids as described above may be employed to operate the laterally movable jogging fingers, the stapling head, and the release gate. Similarly, control means other than the microswitch-cam assembly described in detail above may also be alternatively employed to sequentially operate the various functions of the paper handling machine of the present invention.

Although a specific embodiment of the automatic paper jogging and stapling machine of the present invention has been described above in detail, it is to be understood that this is only for purposes of illustration. This disclosure should not be construed as limiting the scope of the invention, since changes may be made of the described structure by those skilled in the art in order to adapt this paper handling machine to particular applications without departing from the scope of the following claims.

What is claimed is:

1. An automatic sheet jogging and stapling machine comprising:

a downwardly, sidewardly inclined platform for receiving a plurality of sheets, side wall means extending upwardly from said sheet receiving platform to define a side sheet barrier, bottom release gate means mounted for movement to and from a closed position extending upwardly from the lower end of said platform to define a bottom sheet barrier, longitudinally movable jogging means for aligning said sheets into a bundle against said bottom release gate means when closed, laterally movable jogging means for aligning said sheet in the bundle against said side wall means, a stapling head mounted spaced above said sheet receiving platform to staple the aligned paper bundle together, and means for sequentially actuating said laterally and longitudinally movable jogging means, said stapling head, and said release gate to sequentially longitudinally and laterally align said sheet bundle, staple bundle, and then eject said bundle from said receiving platform comprising first actuator means further comprising at least two wheels mounted for rotation under said sheet receiving platform and having a common tangent substantially parallel to said platform and said longitudinally extending slot, an endless member reeved about said wheels lying on said common tangent, said longitudinally movable jogging finger being carried on said member for longitudinal movement through said slot, and drive means for rotating at least one of said wheels for actuating said longitudinally movable jogging means further comprising at least one jogging finger carried on said first actuator means for longitudinal movement through said longitudinal slot second actuator means for actuating said laterally movable jogging means, third actuator means for actuating said stapling head, fouth actuator means for actuating said release gate, and control means for sequentially operating said first second, third, and fourth actuator means.

2. The automatic sheet jogging and stapling machine as claimed in claim 1 wherein said longitudinally movable jogging finger is pivotably mounted on said endless member to be retracted from said longitudinal slot under said sheet receiving platform.

3. The automatic sheet jogging and stapling machine as claimed in claim 2 further comprising:

adjustable stop means positioned along said longitudinal slot for variably, selectively determining the point that said longitudinal jogging finger retracts under said sheet receiving platform.

4. An automatic sheet jogging and stapling machine comprising:

a downwardly, sidewardly inclined platform for receiving a plurality of sheets, side wall means extending upwardly from said sheet receiving platform to define a side sheet barrier, bottom release gate means mounted for movement to and from a closed position extending upwardly from the lower end of said platform to define a bottom sheet barrier, longitudinally movable jogging means for aligning said sheets into a bundle against said bottom release gate means when closed, laterally movable jogging means for aligning said sheets in the bundle against said side wall means, a stapling head mounted spaced above said sheet receiving platform to staple the aligned paper bundle together, and means for sequentially actuating said laterally and longitudinally movable jogging means, said stapling head, and said release gate to sequentially longitudinally and laterally align said sheet bundle, staple bundle, and then eject said bundle from said receiving platform comprising first actuator means for actuating said longitudinally movable jogging means, second actuator means for actuating said laterally movable jogging means, third actuator means for actuating said stapling head, and fourth actuator means comprising at least one link pin mounted on said release gate means, rotatably mounted operator rod mounted in operative relation to said link pin, cam means, mounted on said operator rod for rotation therewith, having a cam surface operatively engaged with said link pin to reciprocally move said release gate to and from its closed position, and means for rotating said operator rod and said cam means to selectively reciprocally move said release gate from its closed position for actuating said release gate, and control means for sequentially operating said first, second, third, and said fourth actuator means.

5. An automatic sheet jogging and stapling machine comprising:

a downwardly, sidewardly inclined platform for receiving a plurality of sheets, side wall means extending upwardly from said sheet receiving platform to define a side sheet barrier, bottom release gate means mounted for movement to and from a closed position extending upwardly from the lower end of said platform to define a bottom sheet barrier, longitudinally movable jogging means for aligning said sheets into a bundle against said bottom release gate means when closed, laterally movable jogging means for aligning said sheets in the bundle against side wall means, a stapling head mounted spaced above said sheet receiving platform to staple the aligned paper bundle together, and means for sequentially actuating said laterally and longitudinally movable jogging means, said stapling head, and said release gate to sequentially longitudinally and laterally align said sheet bundle, staple bundle, and then eject said bundle from said receiving platform comprising first actuator means for actuating said longitudinally movable jogging means, second actuator means for actuating said laterally movable jogging means, third actuator means for actuating said stapling head, fourth actuator means for actuating said release gate, and control means comprising first, second, and third microswitches for operating respectively said second, third, and fourth actuator menas, first, second, and third cam means for actuating said microswitches in proper sequence, and drive means for driving said first, second, and third cam means for sequentially operating said first, second, third, and fourth actuator means.

* * * * *

UNITED STATES PATENT OFFICE

CERTIFICATE OF CORRECTION

Patent No. 3994427 Dated November 30, 1976

Inventor(s) Thomas J. Ganatsiou

It is certified that error appears in the above-identified patent and that said Letters Patent are hereby corrected as shown below:

Column 2, line 56, change "inclinded" to --inclined--.

Column 3, line 53, change "enlarge" to --enlarged--.

Column 6, line 55, change "justifying to --justify--.

Column 6, line 61, change "provided" to --pivoted--.

Column 7, line 62, after "chain", add --78--.

Claim 5, column 10, line 32, change "menas" to --means--.

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*